US009024238B1

(12) United States Patent
Stofko et al.

(10) Patent No.: US 9,024,238 B1
(45) Date of Patent: May 5, 2015

(54) GROUND SURFACE RECONNAISSANCE PROJECTILE

(71) Applicants: Pavol Stofko, Milford, PA (US); Pasquale Carlucci, Fair Lawn, NJ (US); Mark Mellini, Denville, NJ (US); Christopher Mougeotte, Wharton, NJ (US)

(72) Inventors: Pavol Stofko, Milford, PA (US); Pasquale Carlucci, Fair Lawn, NJ (US); Mark Mellini, Denville, NJ (US); Christopher Mougeotte, Wharton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 87 days.

(21) Appl. No.: 13/798,615

(22) Filed: Mar. 13, 2013

(51) Int. Cl.

| | |
|---|---|
| ***F42B 5/08*** | (2006.01) |
| ***F42B 12/02*** | (2006.01) |
| ***F42B 30/10*** | (2006.01) |
| ***F41H 13/00*** | (2006.01) |

(52) U.S. Cl.
CPC ..... *F42B 12/02* (2013.01); *F42B 30/10* (2013.01); *F41H 13/00* (2013.01); *F42B 5/08* (2013.01)

(58) Field of Classification Search
CPC ..... F42B 15/08; F42B 12/02; F42B 30/10
USPC ..... 102/404, 427, 502; 340/870.1; 367/3; 244/3.24
See application file for complete search history.

(56) References Cited

U.S. PATENT DOCUMENTS

| | | | | |
|---|---|---|---|---|
| 5,142,986 | A * | 9/1992 | Gundel | 102/401 |
| 5,198,614 | A * | 3/1993 | de la Haye et al. | 102/401 |
| 6,380,889 | B1 * | 4/2002 | Herrmann et al. | 342/357.57 |

* cited by examiner

*Primary Examiner* — Stephen M Johnson
(74) *Attorney, Agent, or Firm* — Michael C. Sachs

(57) ABSTRACT

A ground surface reconnaissance projectile includes a tube-launched 60 mm inert mortar round, which remotely relays reconnaissance and surveillance data back to an operator, after it has landed and uprighted itself. The types of collected data include for example, visual imagery of the target area in 360 degrees, acoustic target tracking and voice recognition, infra-red motion detection, and magnetic field disturbance sensing.

18 Claims, 19 Drawing Sheets

GROUND SURFACE RECONNAISSANCE PROJECTILE

GOVERNMENTAL INTEREST

The invention described herein may be manufactured and used by, or for the Government of the United States for governmental purposes without the payment of any royalties thereon.

FIELD OF THE INVENTION

The present invention relates to the field of ground sensors, and it more particularly relates to a ground surface reconnaissance projectile which is aerially deployable to a target location.

BACKGROUND OF THE INVENTION

Reconnaissance projectiles, including unattended ground sensors (UGS), have been developed for military use to satisfy the persistent need for reconnaissance, particularly in war situations. An exemplary need is for the prolonged deployment of the reconnaissance projectiles, while maintaining the survivability of the electronic components and sensors housed within the reconnaissance projectiles.

As used herein, a reconnaissance projectile is an unmanned monitoring platform that is often used for various military activities, such as terrain surveillance, troop movement, and target identification. The reconnaissance projectile can include a plurality of sensors. The reconnaissance projectile transmits the acquired sensor data, wirelessly, to a remote unit for analysis and use in field operations.

While numerous types of reconnaissance devices have been proposed, their main function is the general aerial reconnaissance over a target area. These reconnaissance devices may, in certain instances, be delivered to the target location by hand placement or by aerial deployment. Such delivery methods, while efficient for larger reconnaissance devices, may prove to be not feasible or inordinately costly and inaccurate to certain extent, particularly for distributing smaller reconnaissance devices over the target location within an enemy territory, or over a terrain that may be too difficult to reach by foot, such as in a mountainous region.

Higher accuracy in the placement of the reconnaissance devices is desirable to provide accurate peripheral surveillance of the target location.

There is therefore a need for a ground surface reconnaissance projectile which is completely inert, with an electronics package configuration that is designed to survive the gun launch and impact induced forces, while being able to persistently relay reconnaissance data over a long range, for an extended period of time after landing. The need for such a reconnaissance projectile has heretofore remained unsatisfied.

SUMMARY OF THE INVENTION

The present invention addresses the concerns of the conventional ground reconnaissance devices and presents a new remotely static reconnaissance projectile capable of performing ground level Intelligence, reconnaissance and surveillance (ISR), after the projectile has landed for an extended period of time, such as several days or longer.

The reconnaissance projectile has a wide array of sensor types and imaging systems, and can robustly classify targets of interest automatically. The present reconnaissance projectile is comparable to hand placed high values UGS with the significant tactical improvement of remote placement.

According to a preferred embodiment, the present reconnaissance projectile is a 60 mm mortar ground surface reconnaissance projectile, which is completely inert, with electronics package configuration designed to survive the gun launch and impact induced forces, while being able to relay reconnaissance data from a long range.

To this end, the present reconnaissance projectile includes a plurality of interconnected sections: a tail boom, a rear body, a main body, four leg hinge assemblies, and a nose cone (or nose).

The rear body houses a parachute that is deployed in flight to slow the projectile. After landing, the parachute is released and leg hinge assemblies are deployed to cause the projectile to uprights itself on four legs, thereby exposing a plurality of sensors and an antenna for communicating the collected data to an operator at a remote location.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 comprises FIGS. 1A, 1B, and 1C, wherein:

FIG. 2 comprises FIGS. 2A and 2B, wherein:

FIG. 3 comprises FIGS. 3A and 3B, wherein:

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1B:
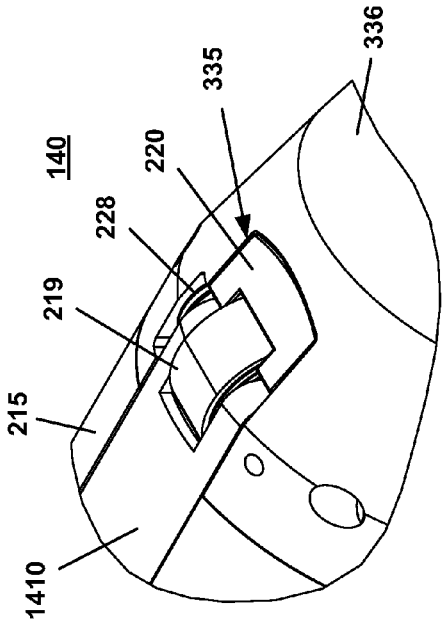
FIG. 1B is an enlarged view of a cutaway section of a leg hinge assembly that forms part of the reconnaissance projectile of FIG. 1A.
Figure 1A:
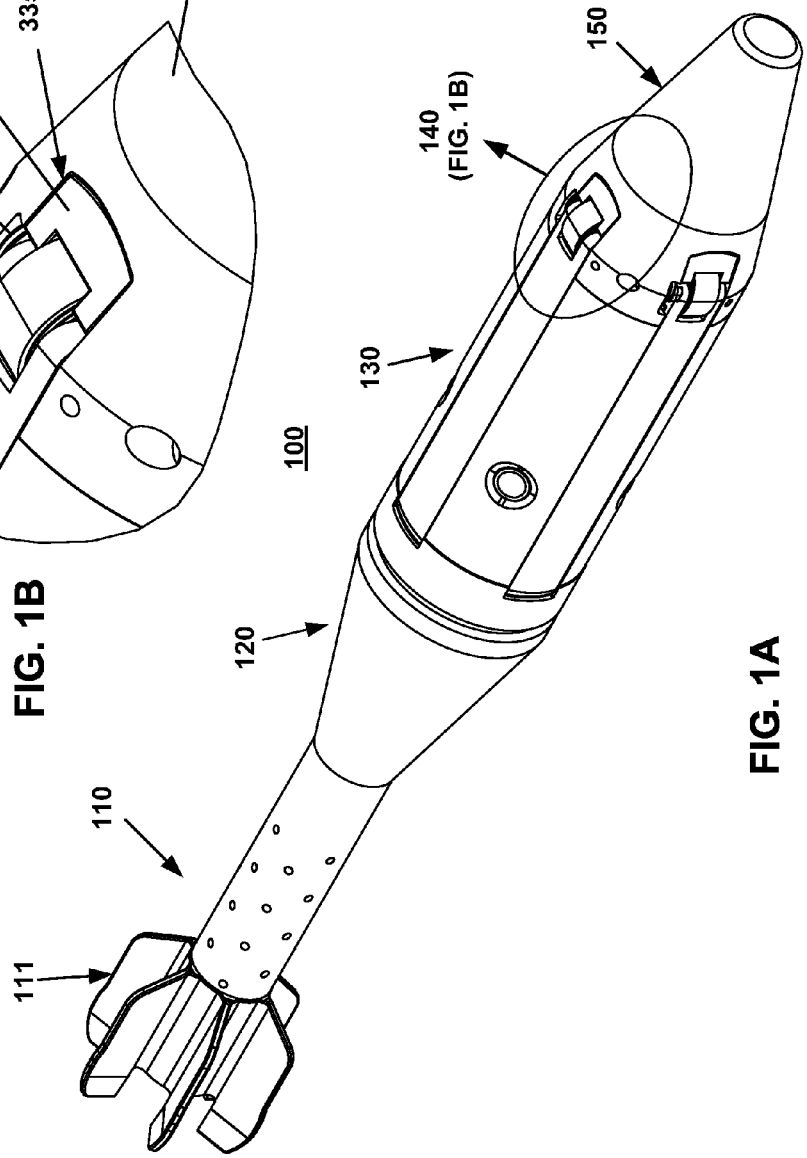
FIG. 1A is a perspective view of a reconnaissance projectile according to the present invention.
Figure 1C:
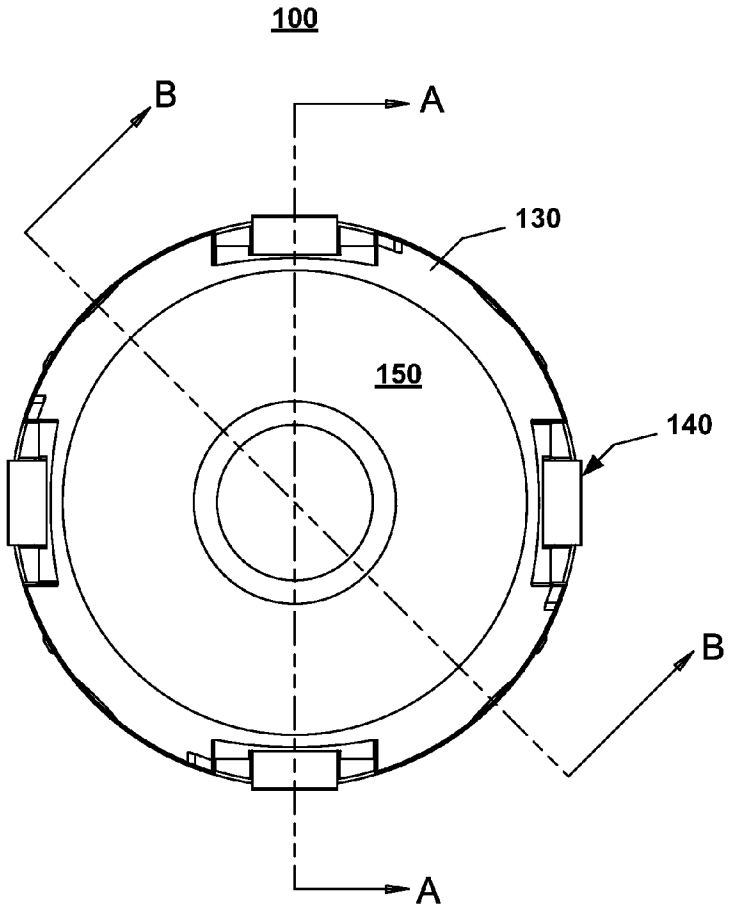
FIG. 1C is an enlarged front view of the reconnaissance projectile of FIG. 1A.

With reference to FIGS. 1A and 1C, the present invention provides a ground reconnaissance device, such as a reconnaissance projectile 100 that is capable of performing ground level Intelligence, reconnaissance and surveillance (ISR) for an extended period of time after the projectile 100 has landed. The projectile 100 generally includes a plurality of interconnected sections: a fail boom 110, a rear body 120, a main body 130, four leg hinge assemblies 140, 141, 142, 143, and a nose cone 150.

The tail boom 110 generally includes a plurality of fins 111, as is known in the field. As a result, the tail boom 110 will not be described in greater detail. Similarly, the nose cone 150 is known in the field and will not be described herein in detail. The outer shape of the nose cone 150 is selected to maintain standard aerodynamic properties.

According to a preferred embodiment of the present invention, the projectile 100 is a 60 mm custom inert mortar projectile whose rear body 120 houses a parachute 700 that will be described later in greater detail in connection with FIG. 7. The parachute 700 is deployed in flight to slow the projectile 100, in order to land softly and to prevent burial in soft terrain.

A bearing assembly 207 (FIG. 2B) forms part of the rear body 120, and is used to allow the main body 130 of the projectile 100 to rotate freely relative to the parachute 700. Such free rotation will ensure that the parachute cords 710 (FIG. 7) does not become entangled.

As the projectile 100 descends, the parachute 700 drags the projectile 100 into a soft landing. After landing, the parachute 700 is released and the leg hinge assemblies 140, 141, 142, 143 are deployed. The projectile 100 uprights itself on four legs 1410, 1411, 1412, 1413 (FIG. 14) of the respective leg hinge assemblies 140, 141, 142, 143, exposing a plurality of sensors and an antenna for communicating the collected data to an operator at a remote location. Numerous different sensors can be used, including but not limited to optical and acoustic sensors.

Having summarily described the general operation of the projectile 100, the design and operation of the projectile 100 will now be described in more detail.

Figure 2A:
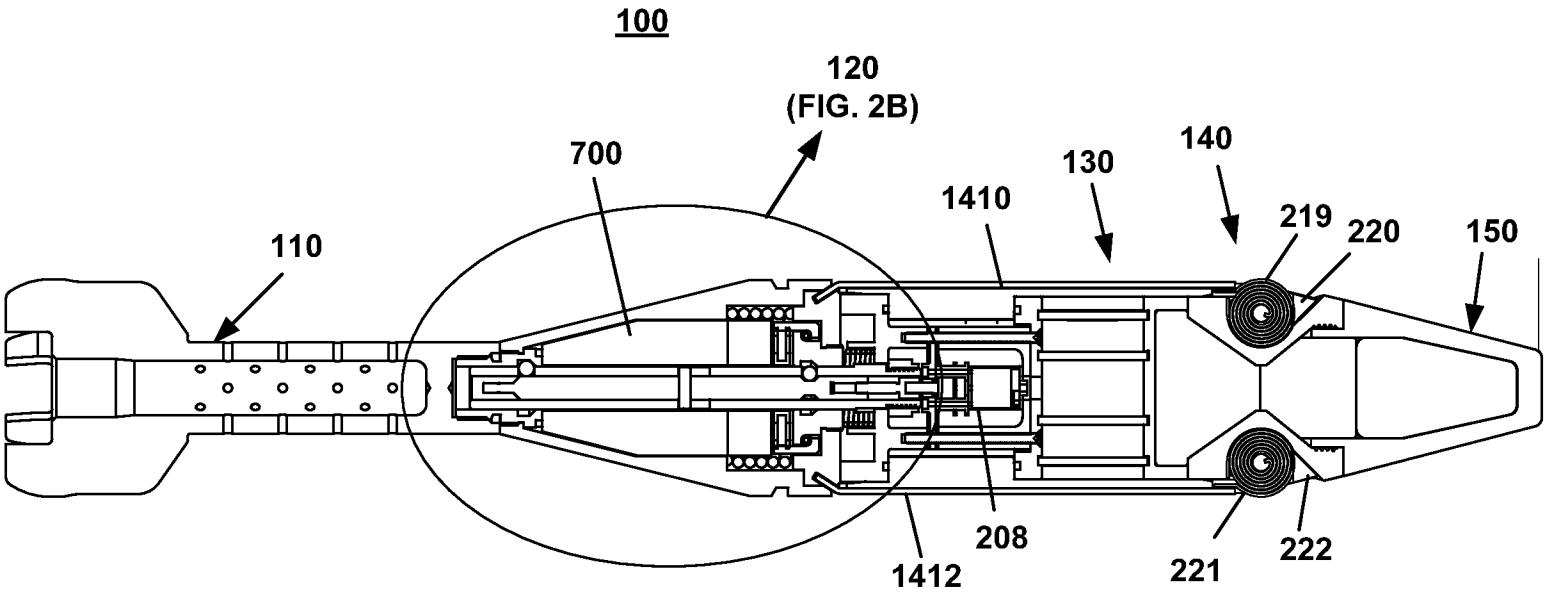
FIG. 2A is a cross-sectional view of the reconnaissance projectile of FIG. 1, taken along line A-A of FIG. 1C.
Figure 2B:
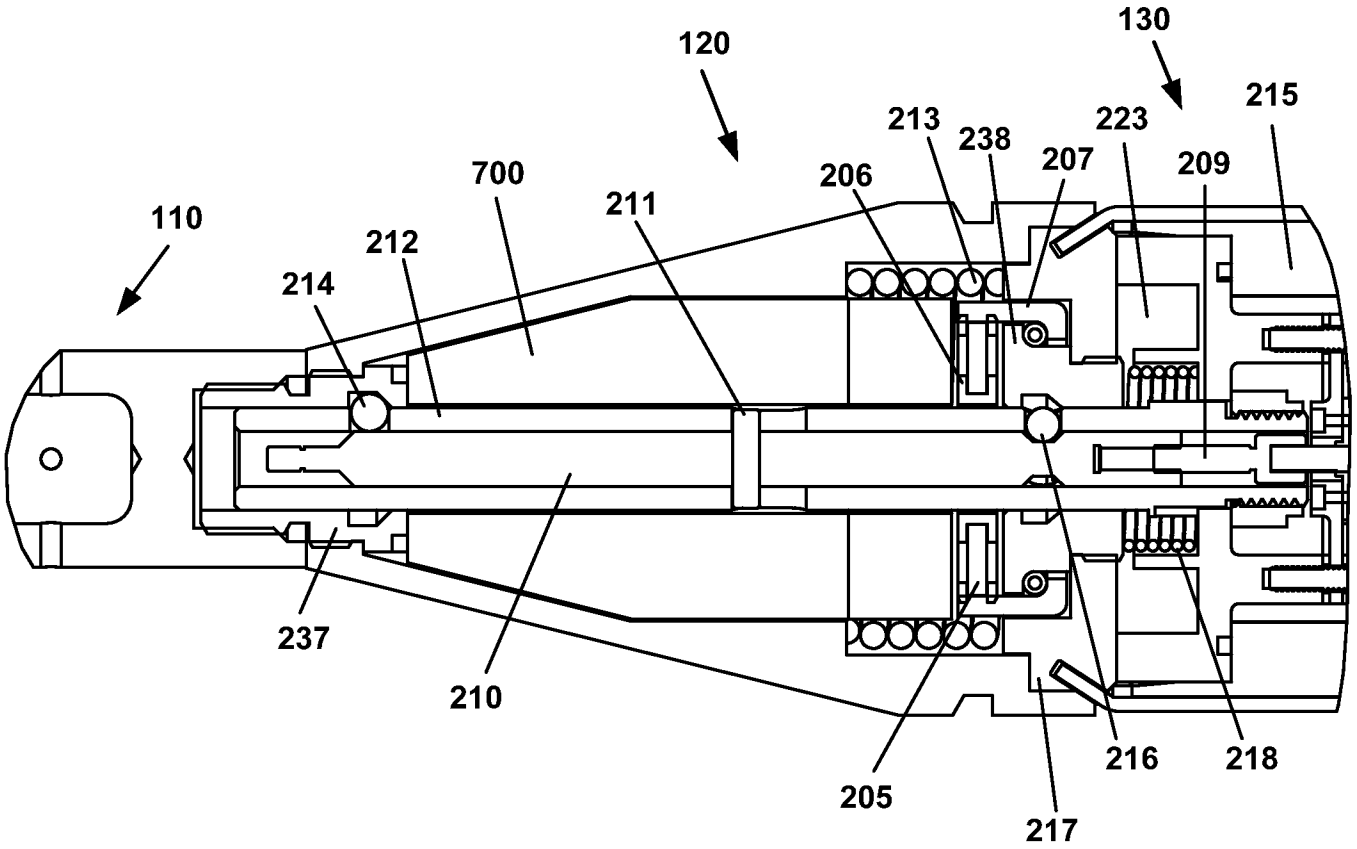
FIG. 2B is an enlarged cross-sectional view of a rear body that forms part of the reconnaissance projectile of FIG. 2A.
Figure 3A:
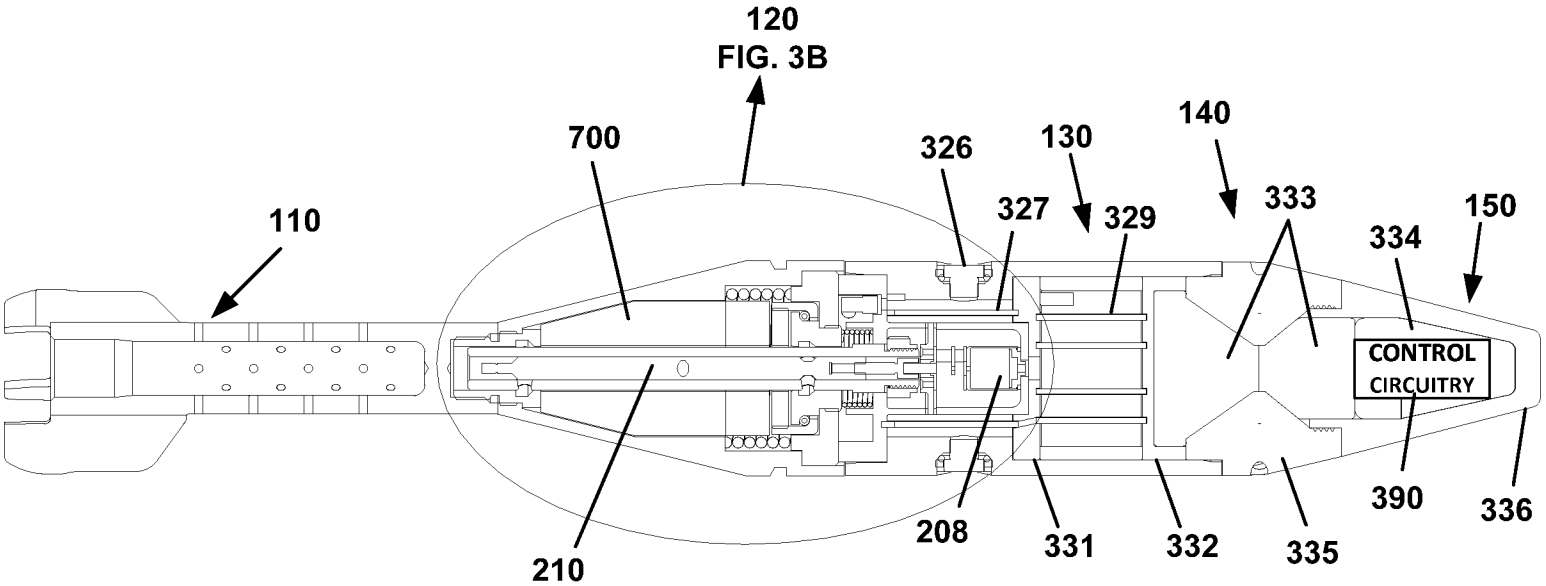
FIG. 3A is a cross-sectional view of the reconnaissance projectile of FIG. 1, taken along line B-B of FIG. 1C.
Figure 3B:
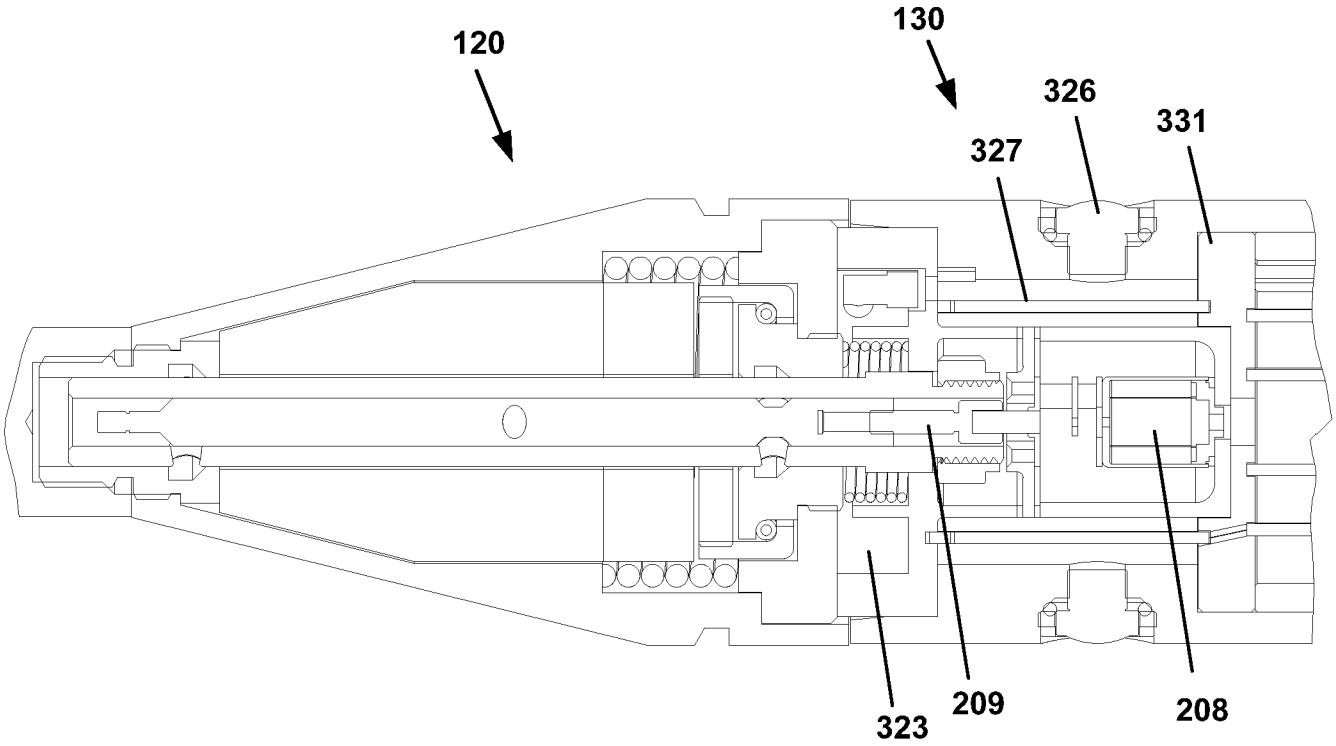
FIG. 3B is an enlarged cross-sectional view of the rear body that forms part of the reconnaissance projectile of FIG. 3A.

With further reference to FIGS. 2 and 3 (FIGS. 2A, 2B, 3A, 3B), FIG. 2A is a cross-sectional view of the projectile 100 taken along line A-A of FIG. 1C. The four leg hinge assemblies 140, 141, 142, 143 are generally similar in construction, function, and design, and are uniformly spaced along the periphery of the main body 130.

FIG. 2A illustrates two legs 1410, 1412 of the leg hinge assemblies 140, 142, respectively, in a stowed position, so as not to adversely affect the aerodynamic performance of the projectile 100 during flight. Each leg hinge assembly 140, 142, is shown to further include a leg spring 219, 221, and a foam damper 220, 222, respectively, whose function will be explained later in more detail.

FIG. 2B is an enlarged view of the rear body 120 of FIG. 2A and further shows parts of the main body 130 and the tail boom 110 to which the rear body 120 is detachably connected. The rear body 120 houses the parachute 700, which is shown in a stowed position, but which is automatically deployed in flight to slow the landing of the projectile 100.

Figure 7:
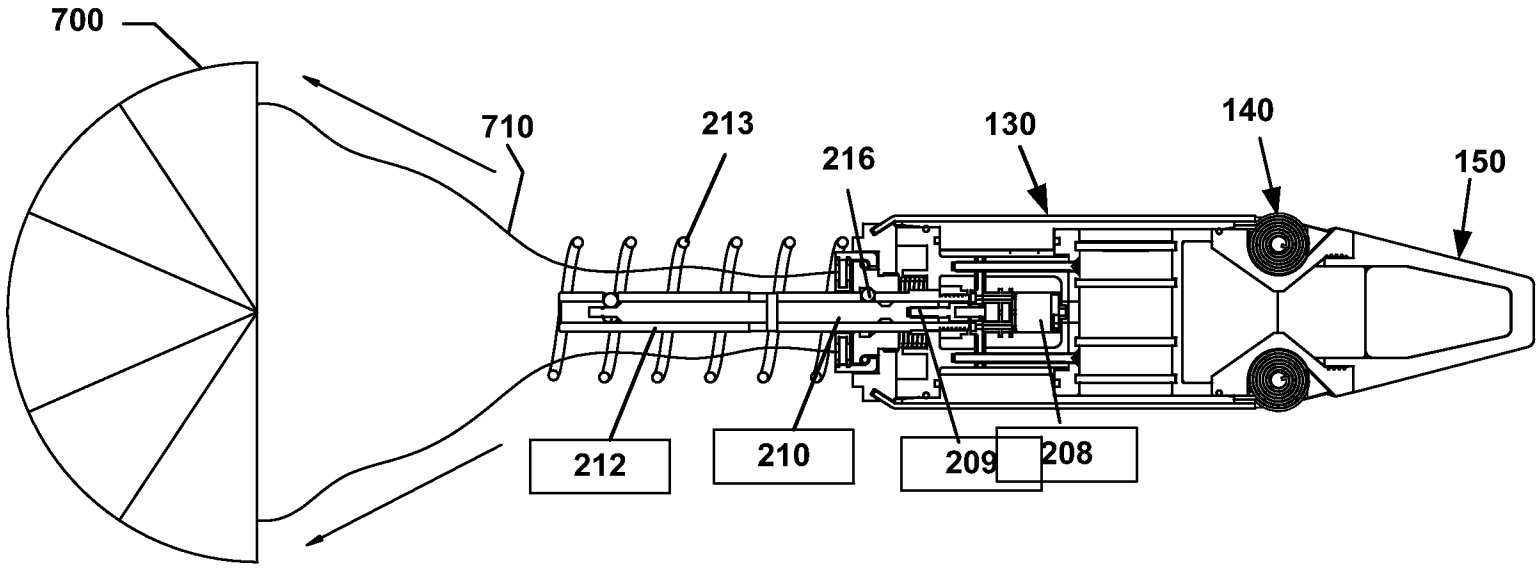

With further reference to FIG. 7, the parachute 700 is tethered by cords 710 to the bearing assembly 207 by means of, for example, pins 205, but the tethering could alternatively be accomplished by a variety of other methods that are available or known. The bearing assembly 207 is used to allow a mortar body 215 of the main body 130, to rotate freely with respect to the parachute 700. This is done to ensure that the parachute cords 710 do not become entangled.

The parachute 700 is automatically deployed through an actuation mechanism 400 (FIG. 4) that comprises the lead screw 209, the axial piston 210, the hollow shaft 212, a rear set of ball detents 214, a front set of ball detents 216, a tail boom adapter 237, a bearing inner race 238, the rear spring 213, and the front spring 218. The actuation mechanism 400 is powered by the electric motor 208 (FIGS. 2A, 3A, 3B). The electric motor 208 forms part of the main body 130 and is connected to a lead screw 209 that extends and translates axially through the main body 130.

The shaft of the motor 208 is pinned to the lead screw 209. In turn, the lead screw 209 is threaded inside of an axial piston 210 that extends and translates axially and linearly, within a hollow shaft 212 of the rear body 120, as the lead screw 209 is caused to rotate by the motor 208. According to another embodiment, the shaft of the motor 208 can act as a lead screw, which could be achieved by having a threading motor shaft.

This linear motion of the axial piston 210 is achieved by pressing a pin 211 through the piston 210 and the hollow shaft 212 that houses the piston 210. The pin 211 acts to prevent any rotational motion of the piston 210. As the lead screw 209 rotates, and because the piston (210) rotation is restrained, the lead screw 209 is forced to translate axially within the hollow shaft 212. The pin 211 serves multiple functions during gun launch.

Figure 4:
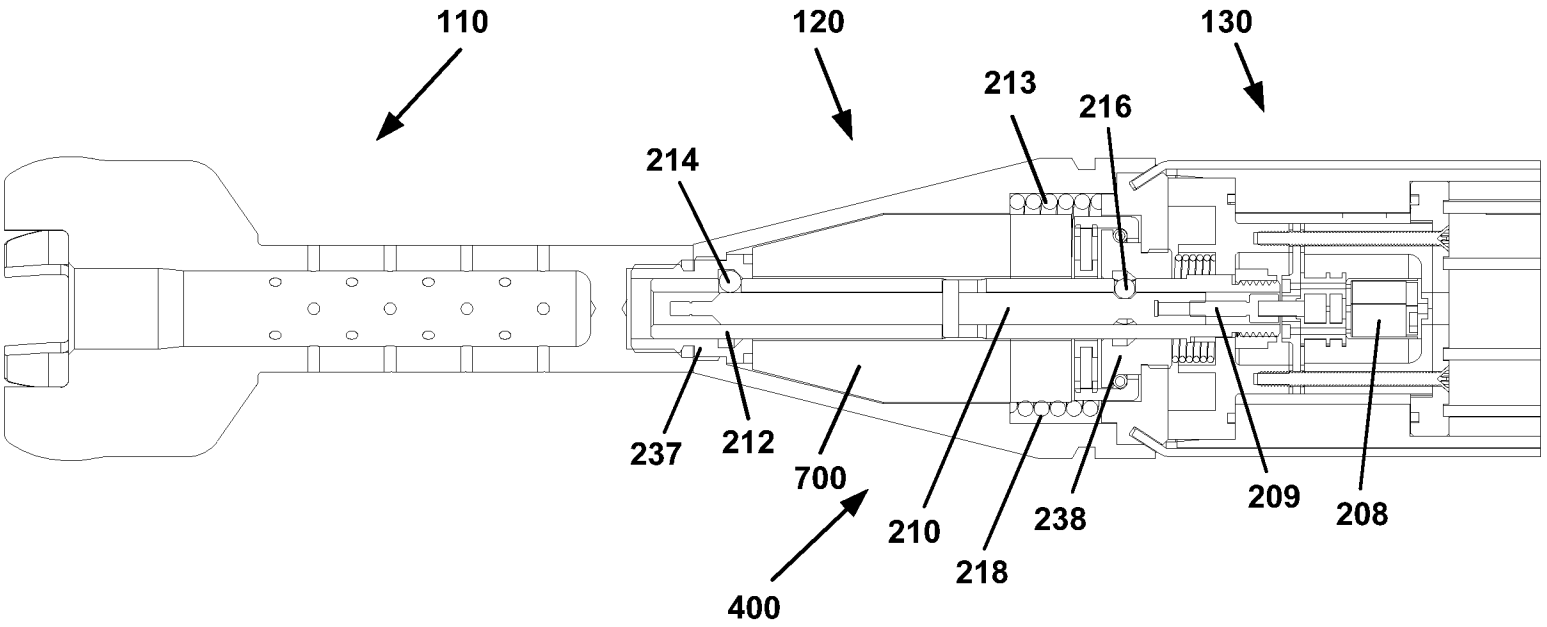
FIGS. 4 through 15 are views of the reconnaissance projectile of FIGS. 1 through 3, that illustrate the sequence of operation of the internal deployment mechanism of the present invention.

As illustrated in FIG. 4, during gun launch, the pin 211 is seated against the bottom of a slot of the hollow shaft 212 and supports the inertial load of the piston 210, to prevent the inertial load from being carried by the motor shaft. This state is referred to herein as "State 1."

Figure 5:
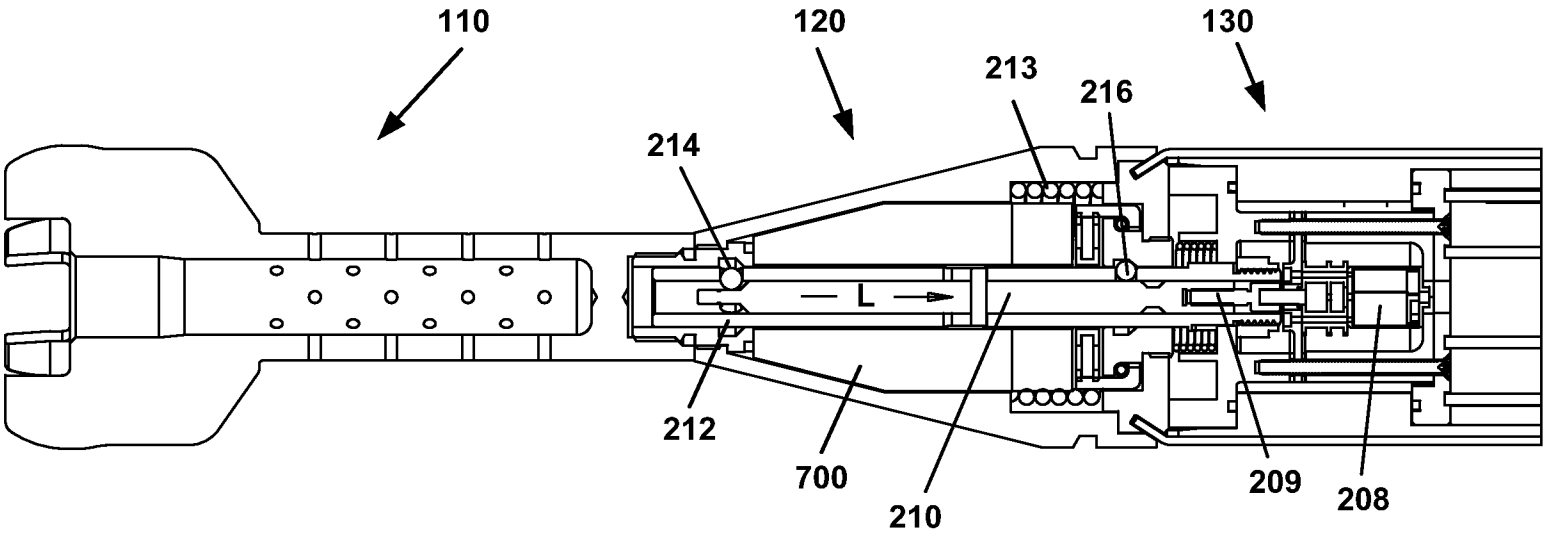

As illustrated in FIG. 5, during flight and landing, as the actuation mechanism 400 is initiated, the pin 211 serves as a mechanical stop for the piston 210 and limits its travel until the pin 211 is bottomed on the front side of the slot of the hollow shaft 212. This state is referred to herein as "State 2." As the projectile 100 lands, the pin 211 serves as a stop and carries the initial loading of the landing impact, so that the load resulting from the impact is not transmitted through the motor shaft, in order to prevent damage to the motor 208.

In the assembled state, the rear body 120 is spring loaded by means of a rear spring 213, and is locked into position via a rear set of ball detents 214, that includes for example three detents. The detents 214 are located on the end of the piston 210 that is adjacent to the tail boom 110. Sealing is provided to prevent damage resulting from high pressure gases and weather conditions. While not shown in the drawings, sealing can be achieved by a plurality of C-rings to prevent high pressure gases from entering the projectile rear body 120 and main body 130.

The sequence of operation of the projectile 100 will now be described in more detail in connection with FIGS. 4 through 15. FIG. 4 illustrates the projectile 100 during the initial stage of the flight, after firing, but prior to activation. The parachute 700 is shown in a stowed position.

At a desired or predetermined altitude of the flight, a control circuitry 390 (FIG. 3A) that is housed within the nose cone 150, includes various electronic packages such as a transmitter, special sensors, timing circuits, and other circuitries. The control circuitry 390 sends an electronic control signal to the motor 208, in order to actuate the actuation mechanism 400. As illustrated in FIG. 5, when the motor 208 turns the lead screw 209 in the clockwise direction, the piston 210 is translated forward relative to the mortar body 215 in the direction of the arrow "L", until it bottoms against the front of the slot of the hollow shaft 212, as described earlier.

At this stage, the motor 208 is electronically shut off and the rear set of ball detents 214 are pushed radially inward, inside the hollow shaft 212 within the rear body 120, by means of the rear spring 213. In the above-referenced State 1, the spring loaded rear body 120 is held in position by the rear set of ball detents 214. The tail boom adapter 237 has a tapered surface that contacts the ball detents 214. The ball detents 214 are captured between the tail boom adapter 237 and the piston 210, to prevent the rear body 120 from being ejected under the action of the rear spring 213.

When the piston 210 moves in the direction of the arrow "L" the ball detents 214 become free to fall into the hollow shaft 212. As the piston 210 moves forward, it exposes a reduced diameter section of the piston 210 to the ball detents 214, such that the ball detents 214 are captured between the tail boom adapter 237 and the piston 210, to prevent the rear body 120 from being ejected under the action of the rear spring 213.

As shown in FIG. 5, the detents 214 are then forced into the hollow shaft 212 until they bottom against the reduced diameter section of the piston 210. The detents 214 are pushed in far enough until they no longer capture the tail boom adapter 237, which enables the rear body 120 to be ejected.

Concurrently, as the piston 210 translates in the direction of the arrow "L" the front set of ball detents 216 get pushed radially outward through the hollow shaft 212 and gets captured between the bearing inner race 238 and the piston 210. Because the ball detents 216 are captured, the bearing assembly 207 is secured to the main body 130. The ball detents 216 retain the bearing assembly 207, which is also preloaded with the front spring 218.

Figure 6:
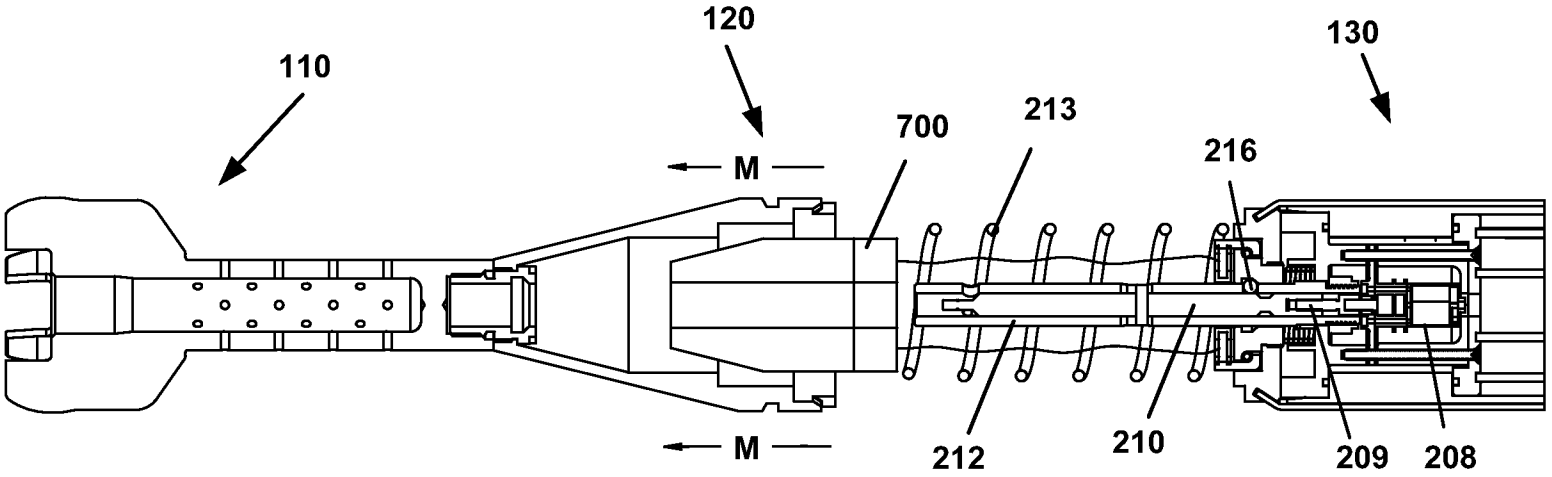

Once in the aforementioned State 2, the tail boom 110, under the action of the preloaded rear spring 213, is jettisoned, as shown in FIG. 6, in the direction of the arrow "M" causing the parachute 700 to be fully deployed. FIG. 7 shows the parachute 700 in a fully deployed state.

Figure 8:
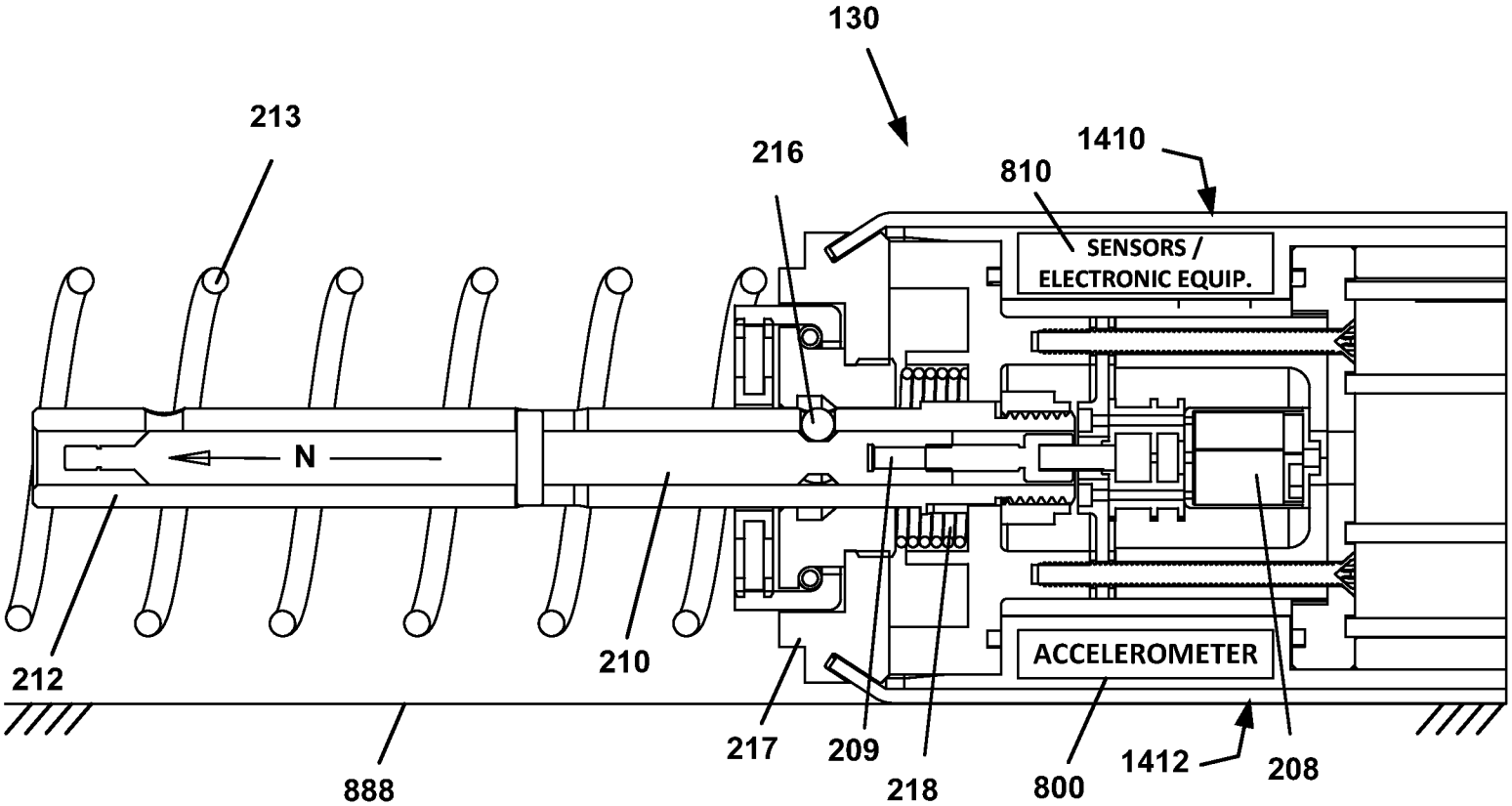

With reference to FIG. 8, after the mortar body 215 has softly landed at the target location 888, an on-board accelerometer 800 sensing no acceleration change, causes the control circuitry 390 to send a control signal to the motor 800 instructing the motor 800 to turn in the counter-clockwise direction. The counter-clockwise rotation of the motor 208, causes the piston 210 to translate axially, rearwardly, relative to the mortar body 215, in the direction of the arrow "N". Concurrently, as the piston 210 translates in the direction of the arrow "N" the front set of ball detents 216 gets pushed radially inward through the hollow shaft 212 due to the spring force of spring 218. and gets captured between the inner bearing race 238 and the piston 210.

Figure 9:
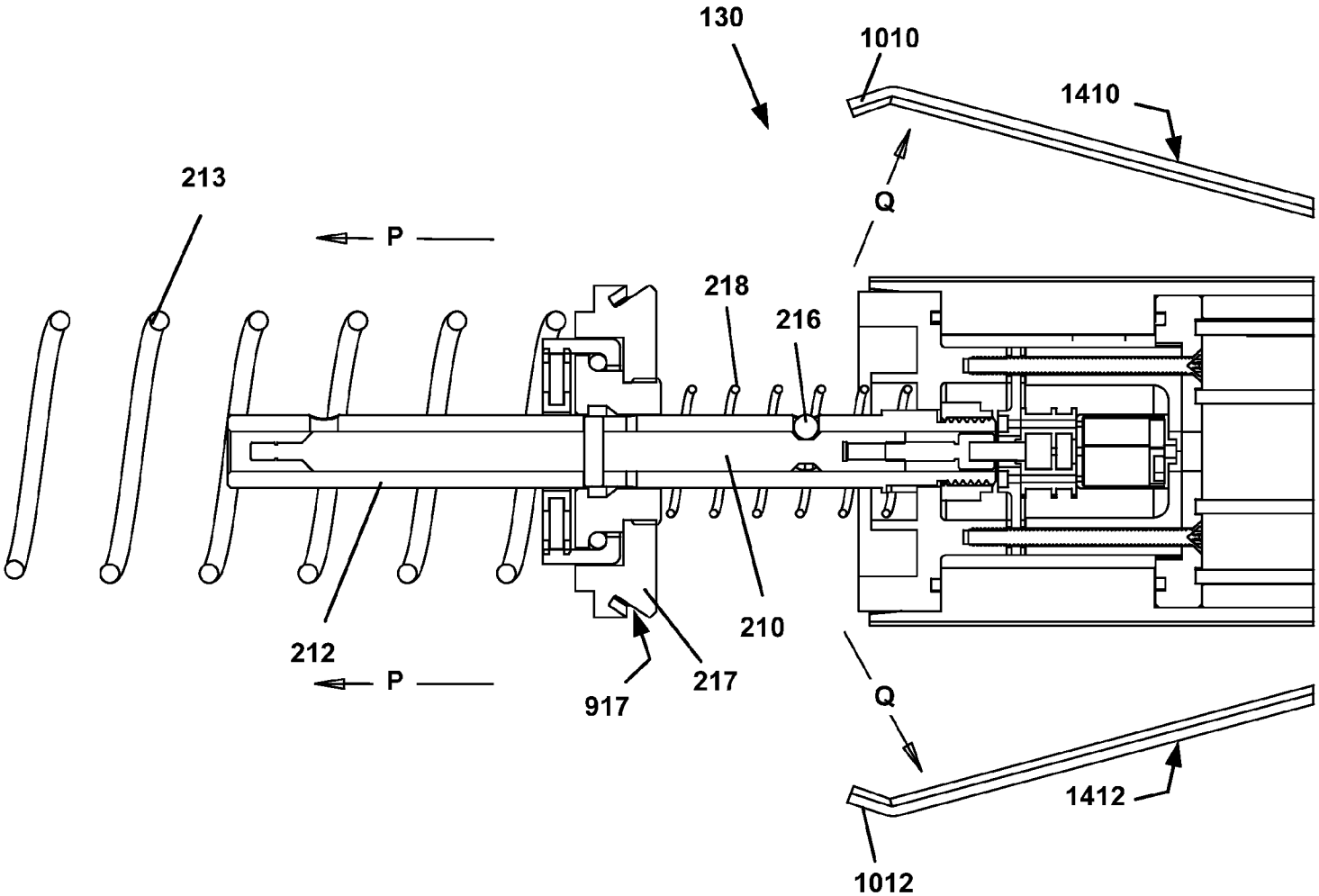

With further reference to FIG. 9, the relocation of the front set of ball detents 216 causes the front spring 218 to act on the bearing assembly 207 and jettisons it in the direction of the arrow "P" until it clears the hollow shaft 212 completely. The leg locking disc 217 includes a recess 917 that engages the four respective feet 1010, 1011, 1012, 1013 of the legs 1410, 1411, 1412, 1413 for retaining the legs 1410, 1411, 1412, 1413 in a locked position, as shown for example in FIG. 8. Concurrently with the ejection of the bearing assembly 207, the leg locking disc 217, which is a part of the bearing assembly 207, is also ejected, thereby leaving the four legs 1410, 1411, 1412, 1413 free to deploy outwardly, along the arrow "Q".

More specifically, while the leg locking disc 217 is engaged to the legs 1410, 1411, 1412, 1413, it is spring loaded by means of a front spring 218. As a result of the relocation of the front set of ball detents 216, the disengagement of the legs 1410, 1411, 1412, 1413 from the leg locking disc 217 causes the front spring 218 to force jettison the leg locking disc 217, the rear spring 213, and the parachute 700, along the arrow "P", along the shaft 212.

Figure 12:
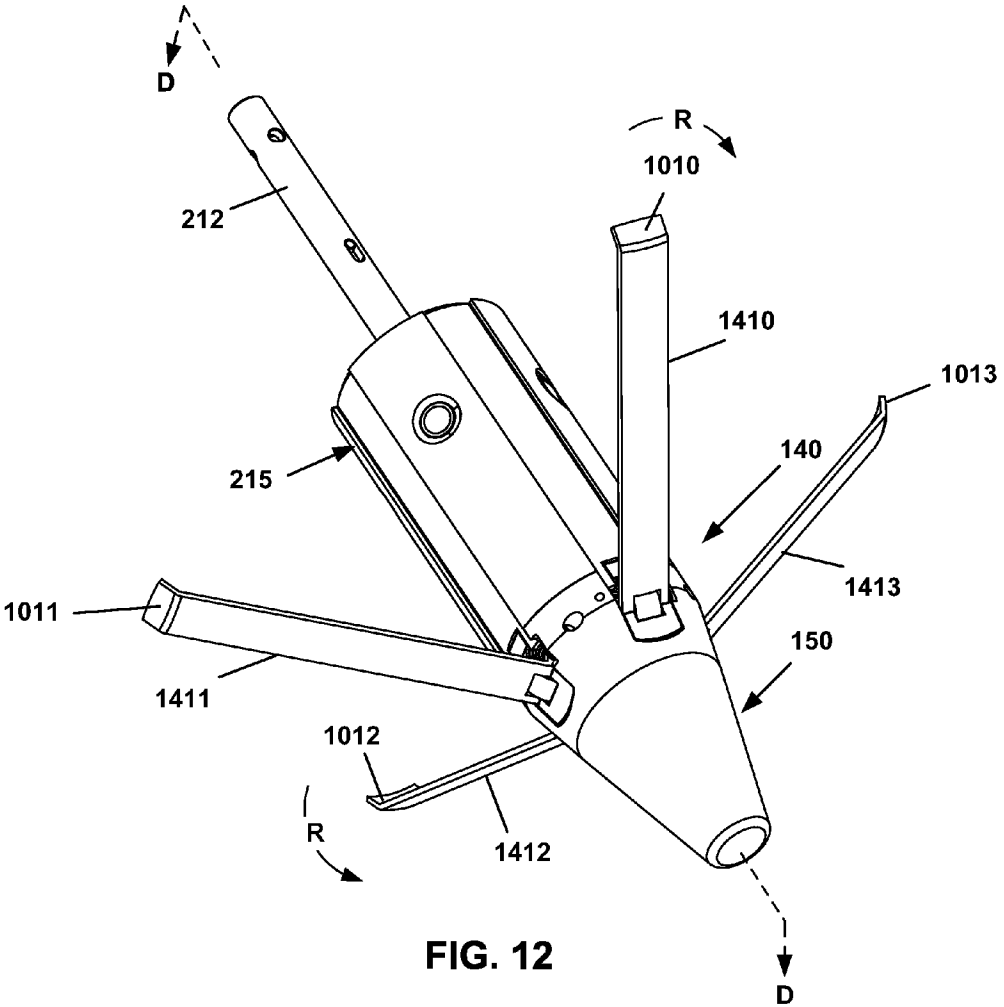
Figure 13:
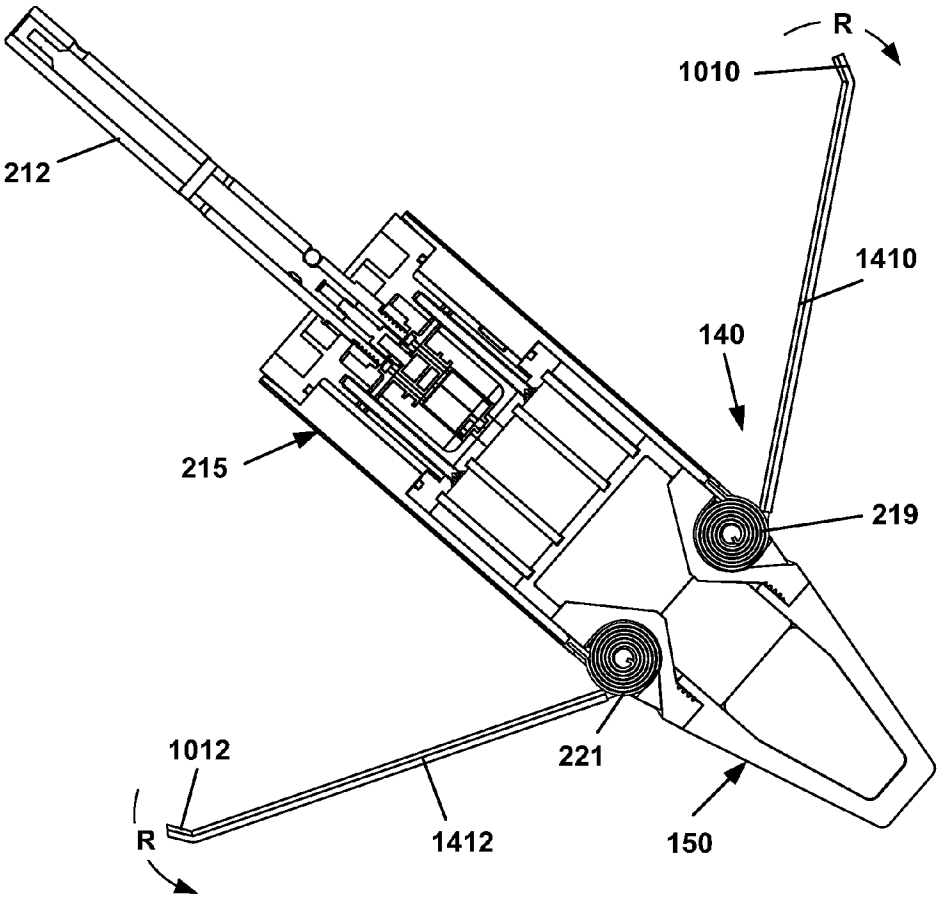
Figure 14:
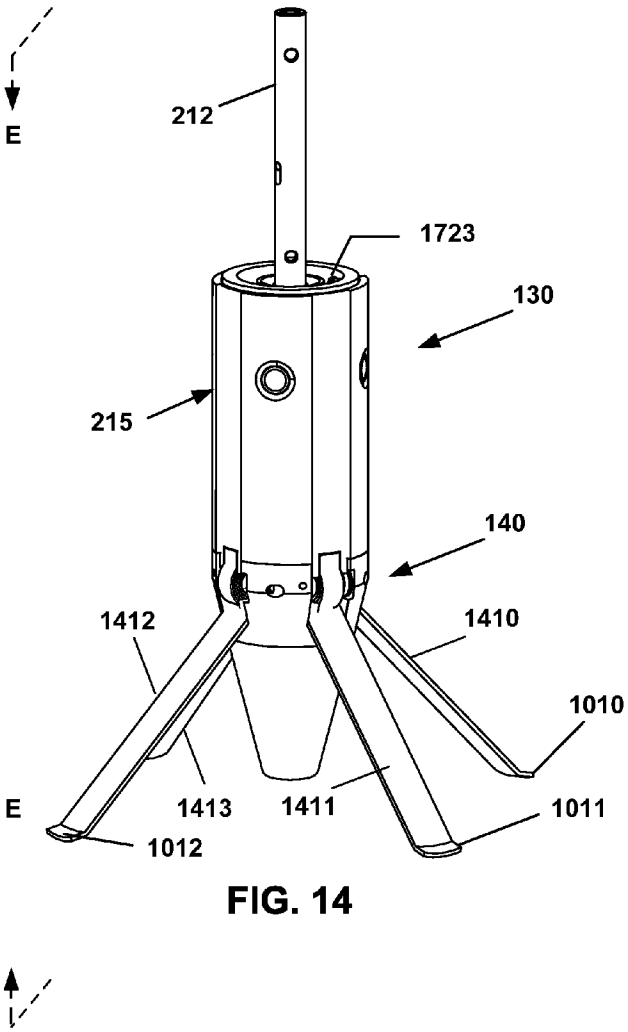

Consequently, and as further illustrated in FIGS. 10-14, the leg locking disc 217, the rear spring 213, and the parachute 700 are then detached from the mortar body 215, and the four spring loaded legs 1410, 1411, 1412, 1413 are forced to open and to upright the mortar body 215 on the ground, as illustrated in FIG. 14. To this end, each leg, such as leg 1410, is provided with a leg spring, such as leg spring 219, which is designed to provide sufficient torque to force the corresponding leg 1410 to open, and further to upright the mortar body 215 as well as to support the weight of the mortar body 215 in the upright position.

Figure 10:
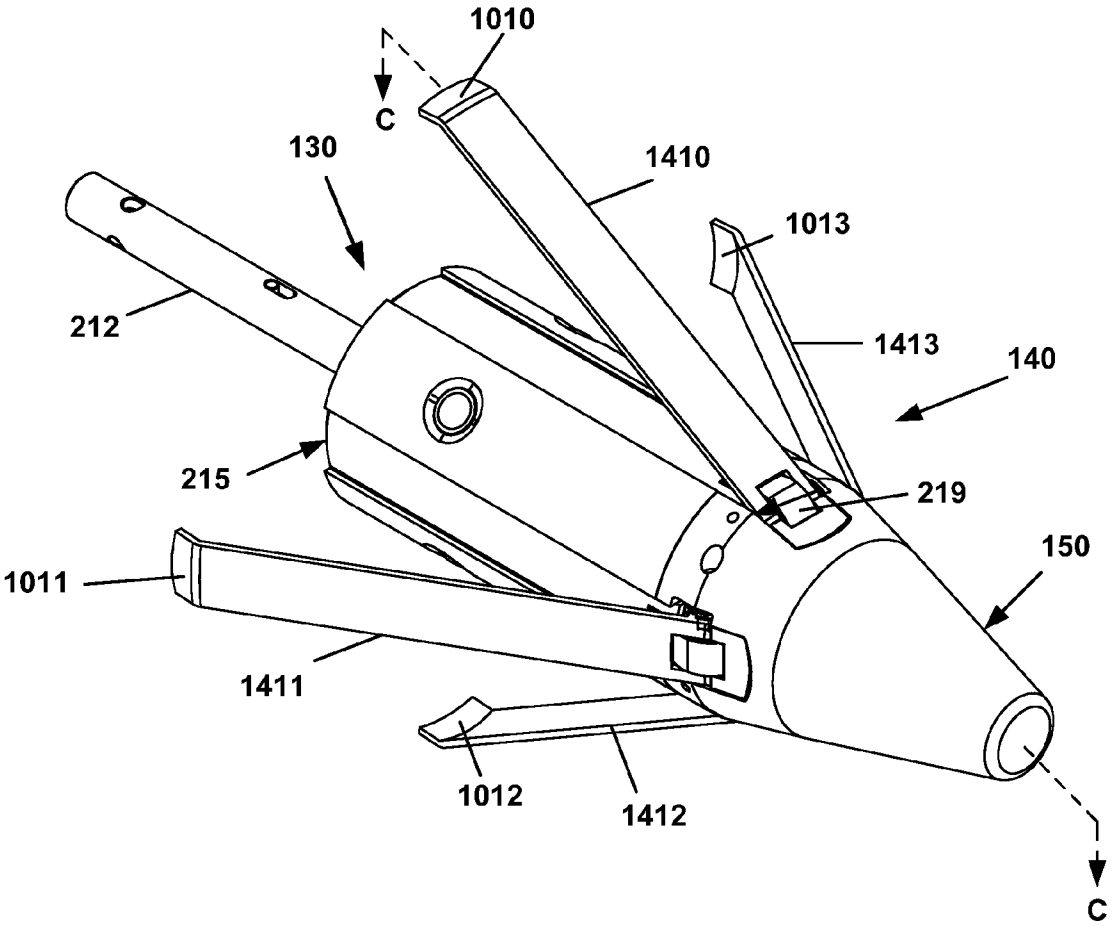
Figure 11:
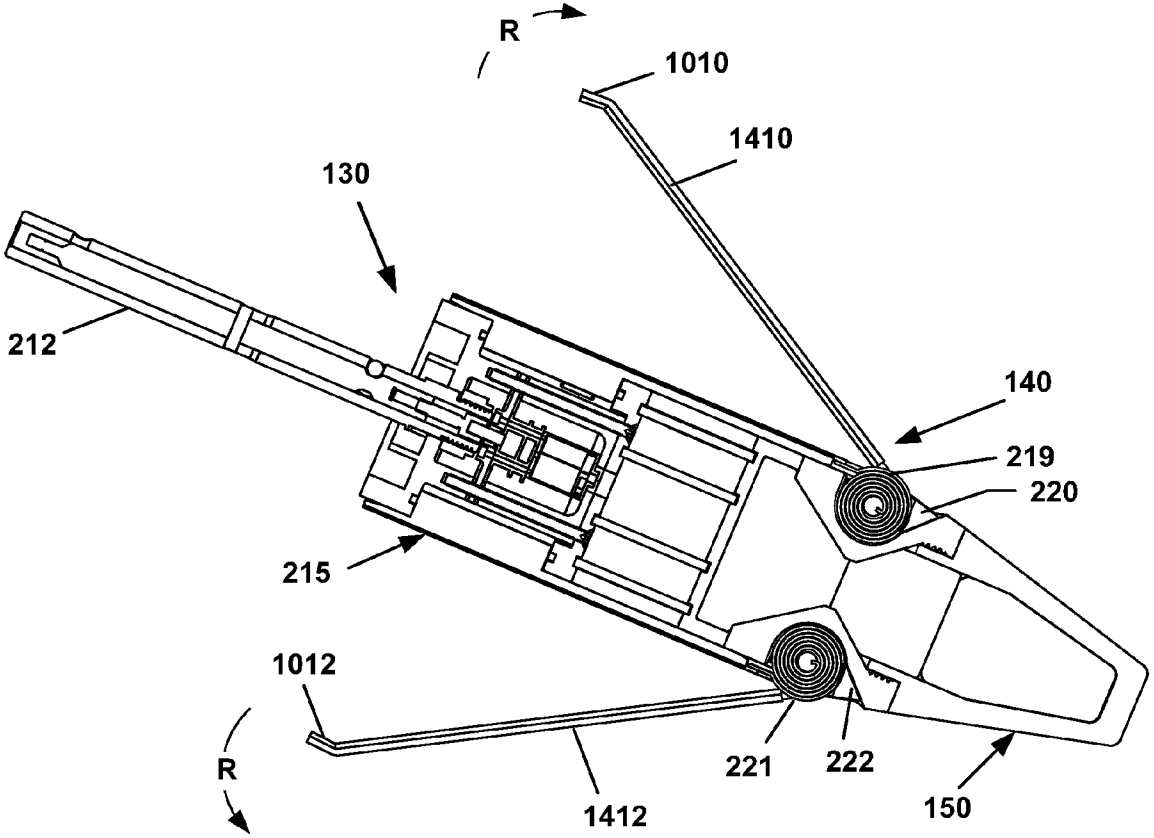

FIG. 11 is a cross-sectional view of the main body 130, the hinge assemblies 140, 141, 142, 143, and the nose cone 150, along line C-C of FIG. 10, following the ejection of the leg locking disc 217, the rear spring 213, and the parachute 700. Two legs 1410, 1412 are shown being deployed by their respective leg springs 219, 221, along the arrow "R".

FIGS. 12 and 13 further illustrate the deployment sequence of the legs 1410, 1411, 1412, 1413, wherein FIG. 13 is a cross-sectional view of the main body 130, the hinge assemblies 140, 141, 142, 143, and the nose cone 150, along line D-D of FIG. 12.

Figure 15:
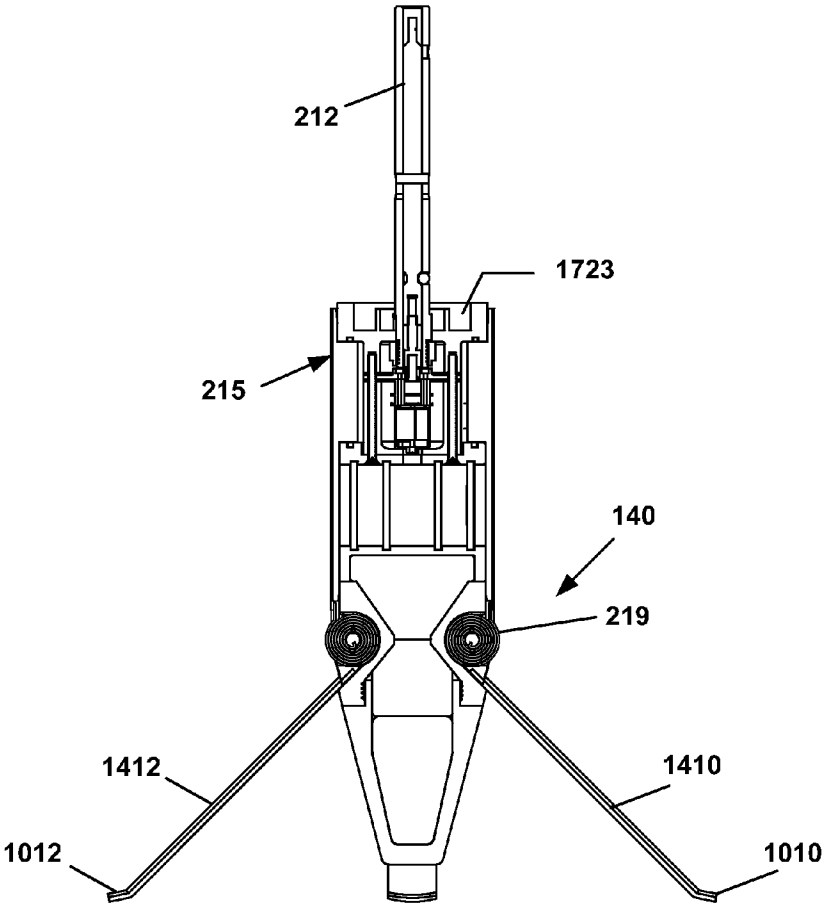

FIGS. 14 and 15 illustrate the main body 130 and the nose cone 150 of the projectile 100 in an upright position, ready to be activated for remote sensing. FIG. 15 is a cross-sectional view of the main body 130, the hinge assemblies 140, 141, 142, 143, and the nose cone 150, along line E-E of FIG. 14.

As explained earlier in connection with FIG. 2A, each leg hinge assembly, i.e., 140, is provided with a foam damper, i.e., 220. Each foam damper, i.e., 220, surrounds a corresponding leg hinge 335 (FIG. 1B), to provide a smooth righting motion.

Figure 17:
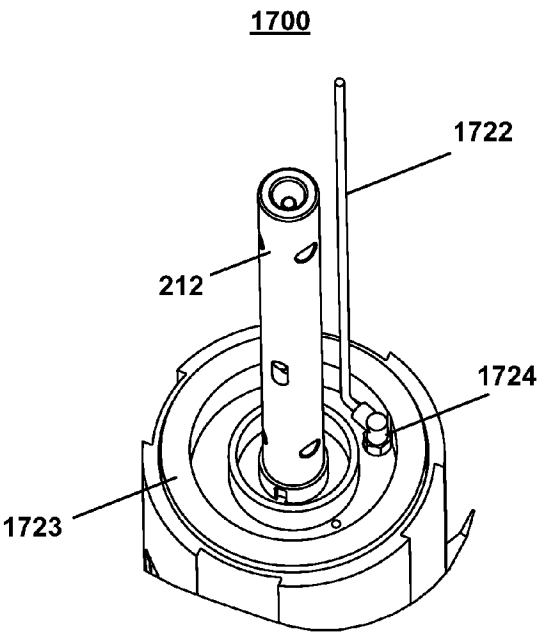
FIG. 17 is an enlarged view of an antenna and support disc section of FIG. 16, illustrating the antenna in an uncoiled position.
Figure 16:
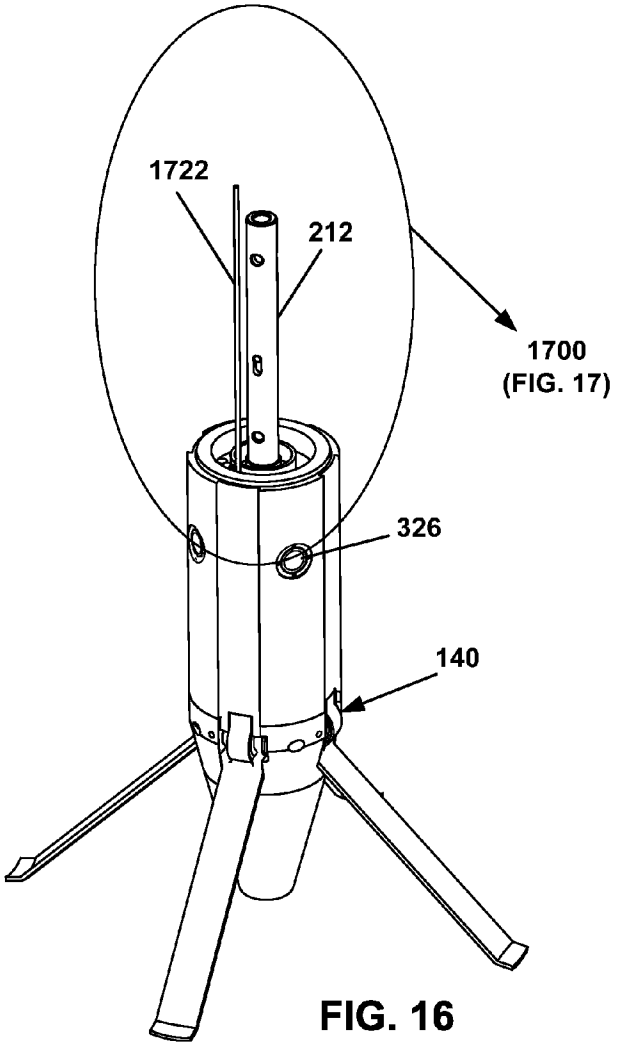
FIG. 16 is a perspective view of the reconnaissance projectile of FIG. 1 after landing and uprighting itself.

At this stage, the mortar sensors and electronic equipment module 810 (FIG. 8) is turned on to remotely relay the reconnaissance data back to an operator. As illustrated in FIGS. 16 and 17, the data transmission is achieved by means of an antenna 1722. The ejection of the leg locking disc 217 exposes the antenna 1722.

The antenna 1722 is connected to the sensors/electronic equipment module 810 by means of a connector 1724. The sensor/electronic equipment module 810 includes various sensors, as demanded by the specific applications of the projectile 100, as well as several cameras lenses 326 (FIGS. 3A, 3B, 16).

The camera lenses 326 are preferably located around the periphery of the mortar body 215, at approximately 45 degrees from each other, and 45 degrees relative to the legs 1410, 1411, 1412, 1413 to create a 360 degree view around the mortar body 215.

One or more additional microphones or sensors may be placed in the antenna cavity of the support disc cavity 1723 of the antenna 1722 (FIGS. 16, 17).

The other electronic components of the projectile 100 may be located within the mortar body 215, and may include, for example, 4 PCB boards 329 (FIG. 3A). All the PCB boards may be placed vertically inside the mortar body 215, along the axial direction of the projectile 100. The PCB boards may be supported in the transverse (up and down) direction can be mounted in a variety of configurations. The sensors, the electronic boards and components, and the power supply (i.e., batteries) are located inside the mortar body 215.

It should be understood that other modifications might be made to the present design without departing from the spirit and scope of the invention.

What is claimed is:

1. A reconnaissance projectile comprising:

a tail boom;

a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and wherein the reconnaissance projectile is an inert mortar projectile that provides unattended reconnaissance after landing.

2. A reconnaissance projectile comprising:
a tail boom;
a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and wherein each leg hinge assembly includes a leg spring and a foam damper.

3. A reconnaissance projectile comprising:
a tail boom;
a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and wherein the rear body and the main body house an actuation mechanism that is powered by an electric motor.

4. The reconnaissance projectile according to claim 3, wherein the actuation mechanism further includes an axial piston that extends and translates axially through the main body.

5. The reconnaissance projectile according to claim 4, wherein the actuation mechanism further includes a lead screw attached to the motor and threaded inside the axial piston.

6. The reconnaissance projectile according to claim 5, wherein the actuation mechanism further includes a hollow shaft, wherein the piston translates inside the hollow shaft.

7. The reconnaissance projectile according to claim 6, wherein the actuation mechanism further includes a rear set of detents that cause the rear body to be released upon activation of the actuation mechanism.

8. The reconnaissance projectile according to claim 7, wherein the actuation mechanism further includes a front set of detents that cause the parachute and the plurality of legs to be released upon activation of the actuation mechanism.

9. The reconnaissance projectile according to claim 8, wherein the actuation mechanism further includes a rear spring that provides stored energy to jettison the rear.

10. The reconnaissance projectile according to claim 9, wherein the actuation mechanism further includes a front spring that provides stored energy to jettison the parachute.

11. The reconnaissance projectile according to claim 3, wherein the actuation mechanism causes the antenna to be exposed upon landing of the projectile.

12. A reconnaissance projectile comprising:
a tail boom;
a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and further comprising a control circuitry that is housed at least in part, within the nose.

13. A reconnaissance projectile comprising:
a tail boom;
a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and further comprising a transmitter that transmits data to a range of approximately 3,500 meters.

14. A reconnaissance projectile comprising:
a tail boom;
a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and wherein the actuation mechanism further includes:
a tail boom adapter; and
a bearing inner race.

15. A reconnaissance projectile comprising:
a tail boom;
a rear body that is releasably secured to the tail boom;
a main body that is releasably secured to the rear body;
a plurality of leg hinge assemblies that are pivotally secured to the main body;
a nose;
wherein the rear body houses a parachute that is deployed in flight to slow the projectile; and
wherein after landing, the parachute is released and the leg hinge assemblies are deployed to cause the projectile to self upright on a plurality of legs, to expose at least one sensor and an antenna for communicating collected data to a remote location, and wherein the tail boom includes a plurality of fins.

16. A reconnaissance projectile comprising:

a tail boom;

a rear body that is releasably secured to the tail boom;

a main body that is releasably secured to the rear body;

a plurality of leg hinge assemblies that are pivotally secured to the main body;

a nose;

wherein the rear body houses a parachute that is deployed in flight to slow the projectile; and wherein after landing, the parachute is released and the leg hinge assemblies are deployed to cause the projectile to self upright on a plurality of legs, to expose at least one sensor and an antenna for communicating collected data to a remote location, and wherein each of the plurality of leg hinge assemblies includes an elastic element that stores energy and that provide the stored energy to the plurality of legs for causing the projectile to self upright after landing.

17. The reconnaissance projectile according to claim 16, wherein each of the plurality of leg hinge assemblies includes a hinge assembly.

18. The reconnaissance projectile according to claim 16, wherein the elastic element includes a spring.

* * * * *